US007482919B1

(12) United States Patent
Franklin

(10) Patent No.: US 7,482,919 B1
(45) Date of Patent: Jan. 27, 2009

(54) MULTI-FUNCTIONAL EMERGENCY EGRESS SYSTEM

(76) Inventor: Larry Franklin, 164 Westwood Blvd., Westwood, NJ (US) 07675

( * ) Notice: Subject to any disclaimer, the term of this patent is extended or adjusted under 35 U.S.C. 154(b) by 187 days.

(21) Appl. No.: 11/499,095

(22) Filed: Aug. 7, 2006

(51) Int. Cl.
*G08B 29/00* (2006.01)

(52) U.S. Cl. ..... 340/506; 340/522; 340/693.5; 182/18

(58) Field of Classification Search ..... 340/506, 340/521–522, 573.1, 693.5; 182/18
See application file for complete search history.

(56) References Cited

U.S. PATENT DOCUMENTS 4,211,306 A * 7/1980 Brenner ..... 182/76
4,237,654 A * 12/1980 Landem et al. ..... 49/141
5,479,151 A * 12/1995 Lavelle et al. ..... 340/542
5,908,082 A 6/1999 Turner et al.
6,249,221 B1 6/2001 Reed
6,771,181 B1 * 8/2004 Hughen, Jr. ..... 340/693.5

* cited by examiner

*Primary Examiner*—Daniel Wu
*Assistant Examiner*—Hongmin Fan

(57) ABSTRACT

An emergency egress system includes a controller that is located within a dwelling, adjacent to a window thereof, and has a user interface. The controller is coupled to an external power supply source, including solar and alternating current power supply sources. Light emitting objects are vertically and horizontally seated about a window perimeter, facing towards the dwelling's interior. A dedicated communications link transmits a distress signal to a monitoring system and is coupled to an alarm, including a smoke-, a fire-, a carbon monoxide- and a security system-alarm. A ladder assembly is positioned adjacent to the window. A mechanism is included for automatically opening the window and the ladder assembly, allowing the occupant to exit the dwelling through the window via the ladder assembly. The automatic window biasing mechanism and the light emitting objects are responsive to a distress signal emitted from the at least one alarm.

12 Claims, 14 Drawing Sheets

MULTI-FUNCTIONAL EMERGENCY EGRESS SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to egress systems and, more particularly, to a multi-functional emergency egress system for assisting occupants of a dwelling to escape from hazardous conditions.

2. Prior Art

The United States has one of the highest fire death rates in the industrialized world. There were 4,045 civilian fire deaths in 2002, which showed a 13.3 percent increase from the previous year. The majority of all fire related deaths are caused by smoke inhalation. Much study has been done about the lethal effects of smoke inhalation which research from the National Fire Protection Association has shown is the leading cause of death in fires to building occupants and firefighters.

Carbon monoxide is the deadliest gas in fire smoke, primarily because the body has a stronger affinity for carbon monoxide than for oxygen. Carbon monoxide molecule passes directly into the bloodstream and it prevents the body from absorbing oxygen. Unfortunately, many individuals become disoriented in smoke filled rooms and lose precious time trying to find an exit way, time in which they are exposed to carbon monoxide and toxic fumes. In many cases, individuals have died only a few feet away from an exit and safe haven, only because they were disoriented and had lost too much time trying to find a way out. Obviously, it would be advantageous to provide a means for guiding people out of a burning building in a timely and safe manner.

Accordingly, a need remains for a multi-functional emergency egress system in order to overcome the above-noted shortcomings. The present invention satisfies such a need by providing a system that is convenient and easy to use, is automatic in its operation, and effectively provides users with a safe and quick means to egress a burning building. Such a system is especially helpful to those suffering from physical disabilities and others with limited mobility. The automatic operation of the system advantageously allows the user to direct all their time and energy to reaching an egress point. The solar back up power supply source also ensures that the system will be operational in the event of a power outage.

BRIEF SUMMARY OF THE INVENTION

In view of the foregoing background, it is therefore an object of the present invention to provide a multi-functional emergency egress system. These and other objects, features, and advantages of the invention are provided by a multi-functional emergency egress system for assisting occupants of a dwelling to escape from hazardous conditions.

The emergency egress system includes a controller that is located within the dwelling and is disposed adjacent to a window of the dwelling. Such a controller includes a user interface. The controller is electrically coupled to an external power supply source that includes at least one of a solar power supply source and an alternating current power supply source respectively.

A plurality of illuminable light emitting objects are seated about a perimeter of the window and face towards an interior of the dwelling. Such light emitting objects are horizontally and vertically oriented for advantageously and effectively defining a location and shape of the window.

A dedicated communications link is provided for transmitting a distress signal to a remotely located monitoring system. Such a dedicated communications link is electrically coupled to at least one alarm selected from the group including a smoke alarm, a fire alarm, a carbon monoxide alarm and a security system alarm of the dwelling.

A ladder assembly is housed to an exterior of the dwelling and is positioned adjacent to the window. Such a ladder assembly may be positioned directly above the window and includes a protective awning that has a curvilinear top surface sloping downwardly and away from the dwelling. A motor has a linear drive shaft directly coupled thereto. Such a motor and drive shaft are nested beneath the awning. A spool is horizontally registered adjacent to the motor. First and second pulleys are directly connected to the drive shaft and the spool respectively. A unitary belt is coupled about the first and second pulleys. The ladder is journaled about the spool and is selectively released when the motor rotates the drive shaft such that the first and second pulleys rotate in sync and effectively cause the ladder to wind and unwind about the spool during emergency situations.

A mechanism is included for automatically biasing the window and the ladder assembly to an open position such that the disabled occupant is advantageously and effectively able to exit the dwelling through the window via the ladder assembly respectively. The automatic window biasing mechanism and the illuminable light emitting objects are responsive to a distress signal emitted from the at least one alarm. Such an automatic window biasing mechanism preferably includes first and second actuators that are operably coupled to the window and to the ladder assembly respectively.

A processor is electrically coupled to the first and second actuators, and a memory is electrically coupled to the processor. Such a memory includes software instructions that effectively and conveniently cause the window to pivot along a vertical axis and swing outwardly away from the dwelling. The software instructions execute a programmable logic algorithm that includes the steps of determining whether the distress signal has been transmitted, calculating a period of time since the distress signal was initially transmitted, and comparing the time period with a threshold time period. Further steps include determining if the time period is less than the threshold time period, conveniently ignoring the distress signal and resetting the time period to a false value, and if the time period is greater than the threshold time period, effectively generating and simultaneously transmitting a plurality of control signals to the first and second actuators such that the window and the ladder assembly are advantageously simultaneously biased to open and expanded positions respectively.

A protective fire curtain assembly may be directly coupled to an exterior of the window of the dwelling. A mechanism is included for automatically biasing the fire curtain assembly between raised and lowered positions when the distress signal is detected from the at least one alarm. Such a biasing mechanism is electrically coupled directly to the at least one alarm. The protective fire curtain assembly preferably includes a pair of linear guide rails that are directly connected to an exterior of the dwelling and vertically oriented on opposed sides of the window. Each of the guide rails has coextensive lengths traveling along an entire longitudinal height of the window. A flexible awning has a plurality of planar sides that protrude outwardly from a periphery of the window. Such sides are statically affixed to each other and define a hollow cavity between the window and an inner wall of the awning for effectively and advantageously sheltering the disabled occupant from an interior of the dwelling and exterior ambient surroundings.

A motor assembly is electrically coupled to the controller. At least one rotary gear assembly is housed within an exterior wall of the dwelling and is operably engaged directly with at least one of the guide rails. Such a rotary gear assembly includes a toothed drive gear that is partially seated within the one guide rail. A linear anchor arm traverses through a center of the rotary gear. A pair of coextensively shaped rollers are equidistantly spaced along opposed sides of the drive gear. Such rollers are operably connected to the awning. A slotted linear track is contiguously housed within the one guide rail and extends along an interior chamber thereof. The drive gear is continuously locked with the track such that the rollers effectively bias the awning along the guide tracks when the distress signal is emitted by the at least one alarm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
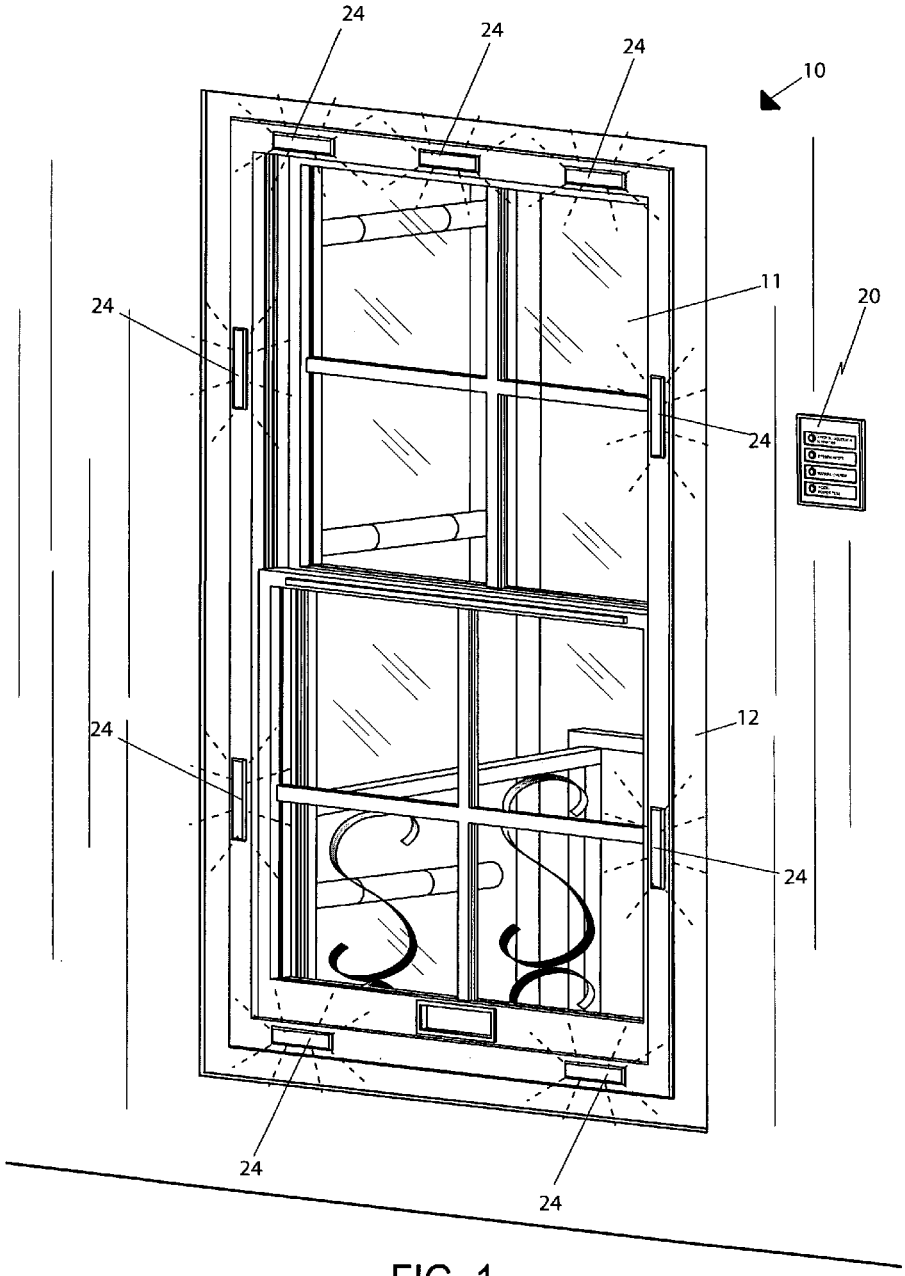
FIG. 1 is a perspective view showing a multi-functional emergency egress system, in accordance with the present invention.
Figure 2:
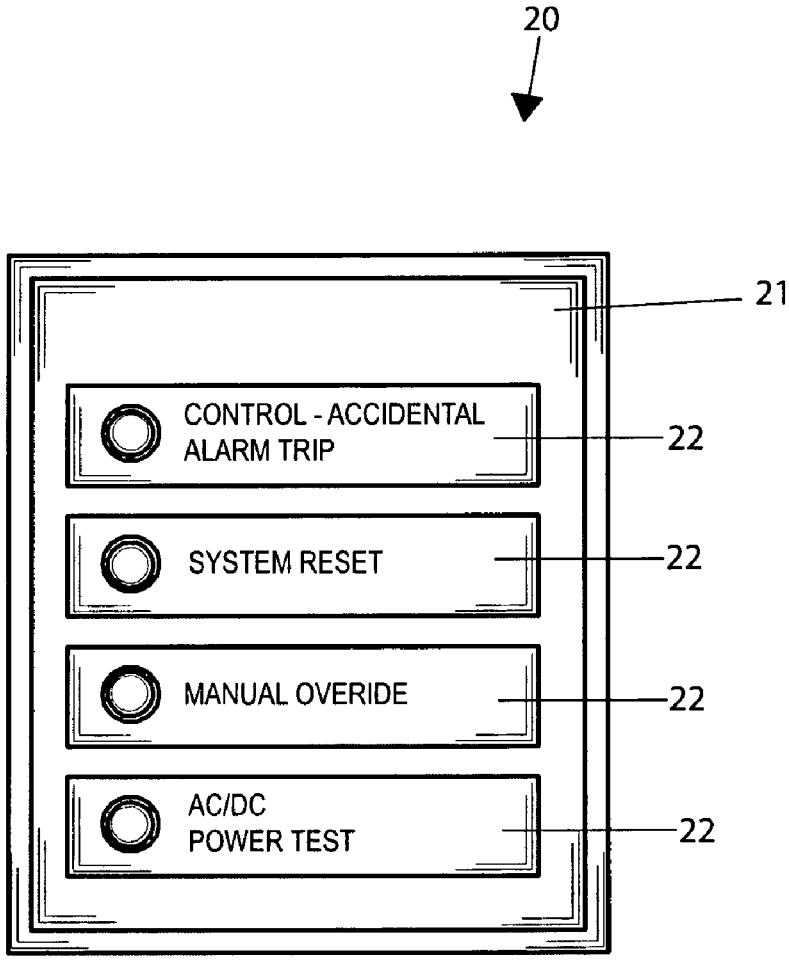
FIG. 2 is an enlarged front-elevational view of the controller user interface shown in FIG. 1.
Figure 3:
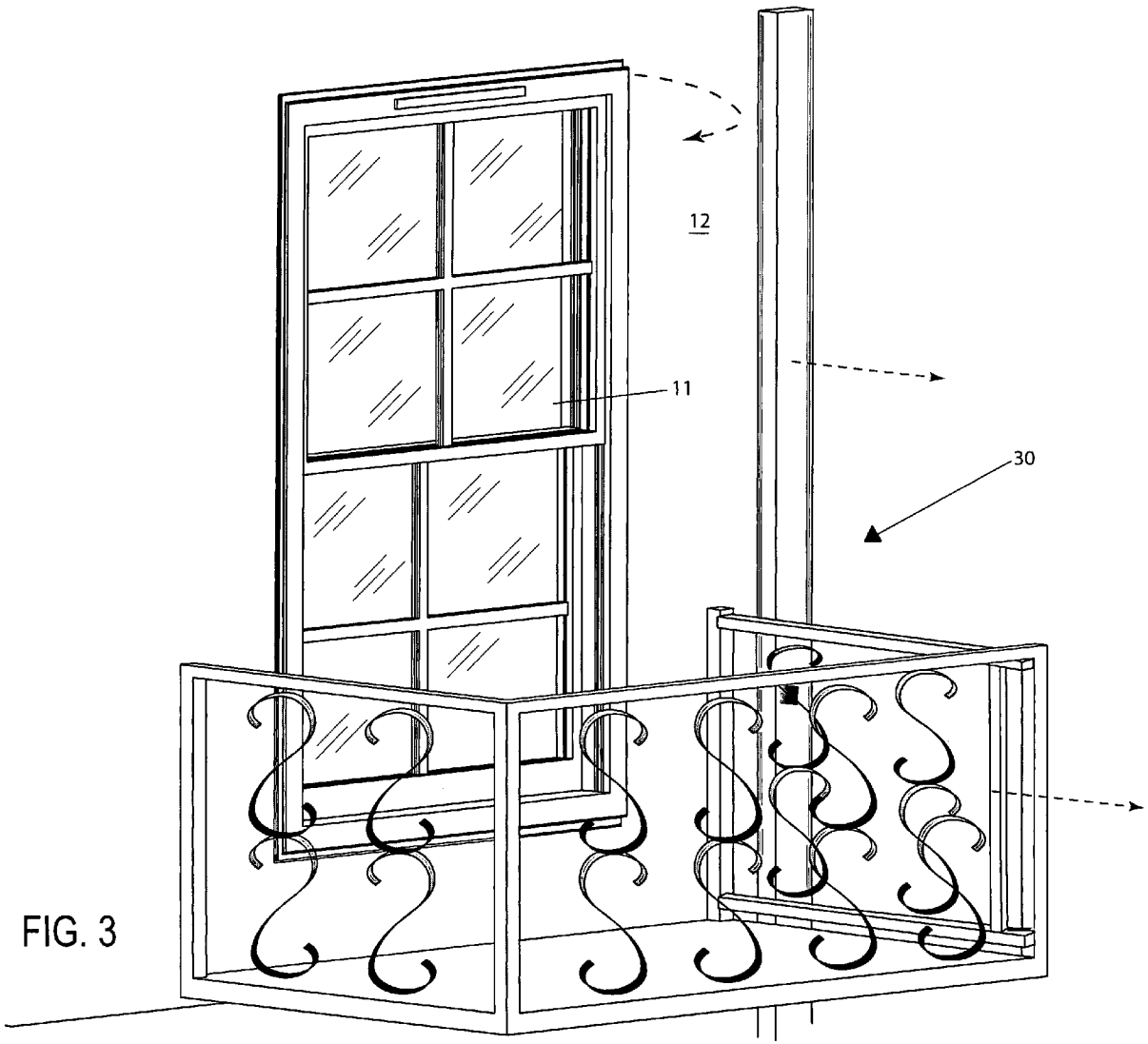
FIG. 3 is a perspective view showing the window and the ladder assembly at a closed or retracted state, in accordance with the present invention.
Figure 4:
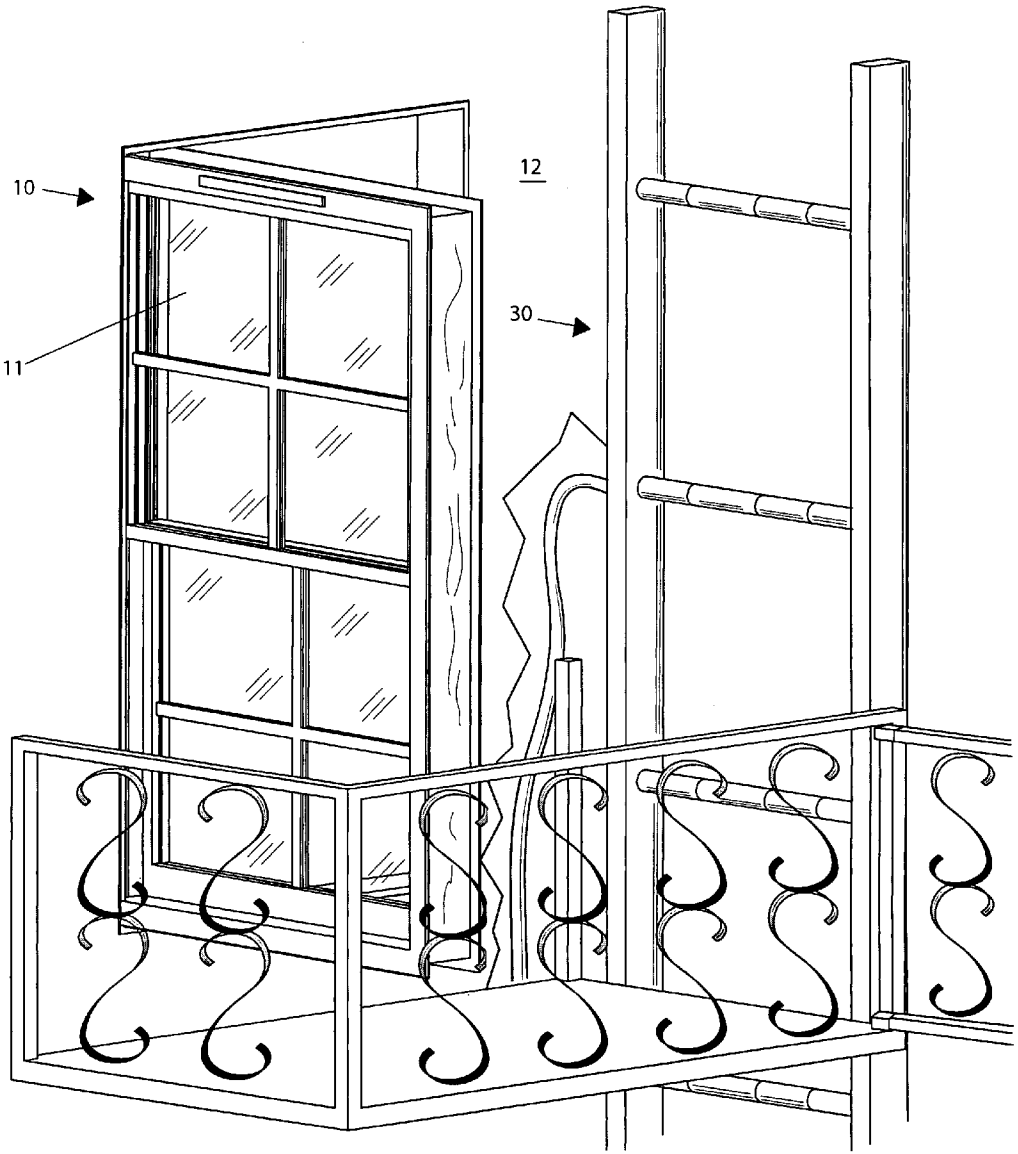
FIG. 4 is a perspective view of the system shown in FIG. 3, showing the window and the ladder assembly at their extended positions, respectively.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-17 by the reference numeral 10 and is intended to provide a multi-functional emergency egress system. It should be understood that the system 10 may be used to assist many different types of people exit a burning, or other wise hazardous, dwelling and should not be limited to only being used by physically disabled individuals.

Referring initially to FIGS. 1, 2, 8, 9 and 16, the system 10 includes a controller 20 that is located within the dwelling and is disposed adjacent to a window 11 of the dwelling 12. Such a controller 20 includes a user interface 21 that includes a plurality of buttons 22 that are essential for activating and setting the various functions and modes of the system 10, respectively. The controller 20 is electrically coupled to an external power supply source 23 that includes at least one of a solar power supply source 23A and an alternating current power supply source 23B respectively. Such a solar power supply source 23B is crucial and advantageous for ensuring that the system 10 can still operate in the event of a power outage.

Figure 6:
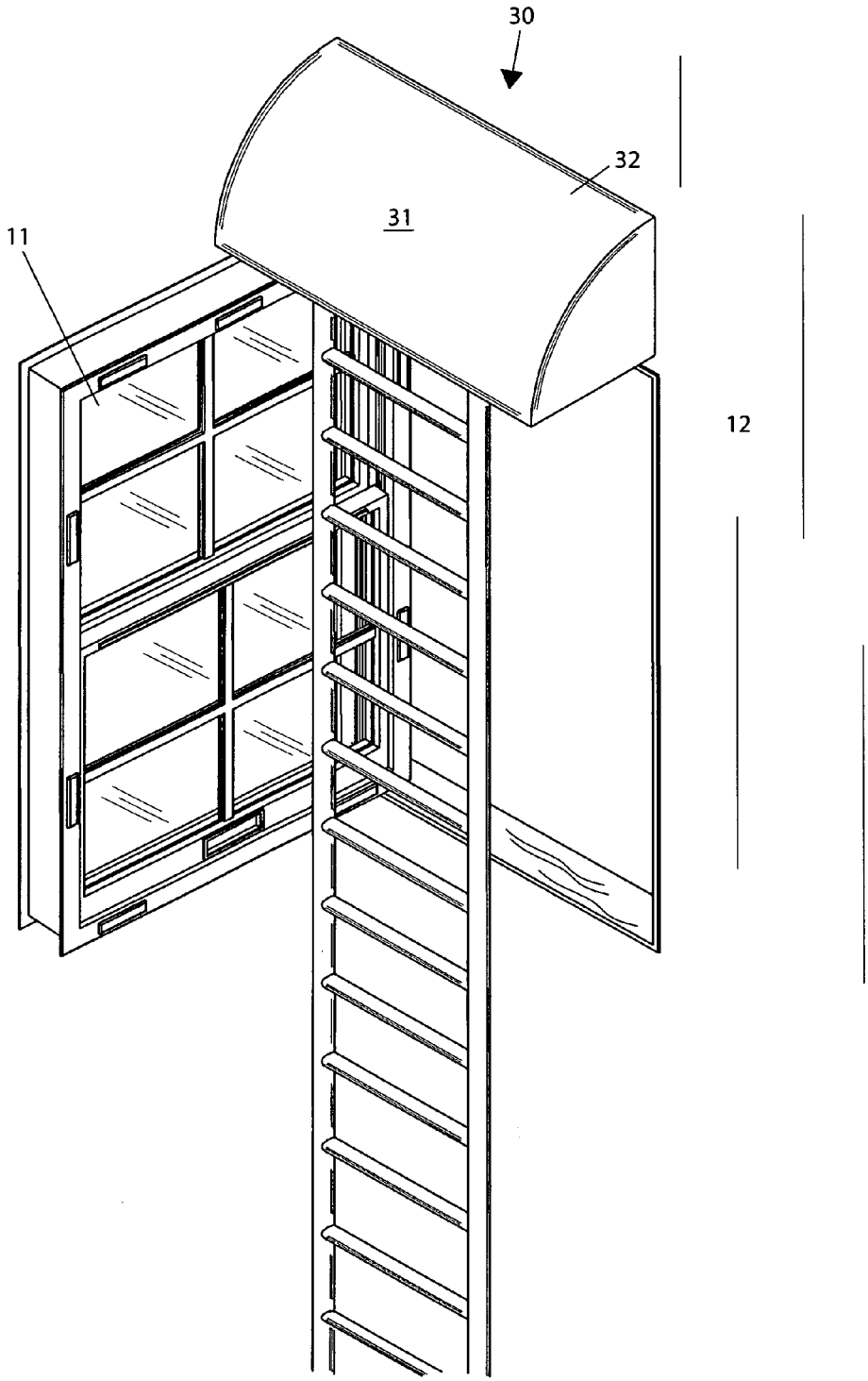
FIG. 6 is a perspective view showing the ladder assembly at an extended state, in accordance with the present invention.
Figure 7:
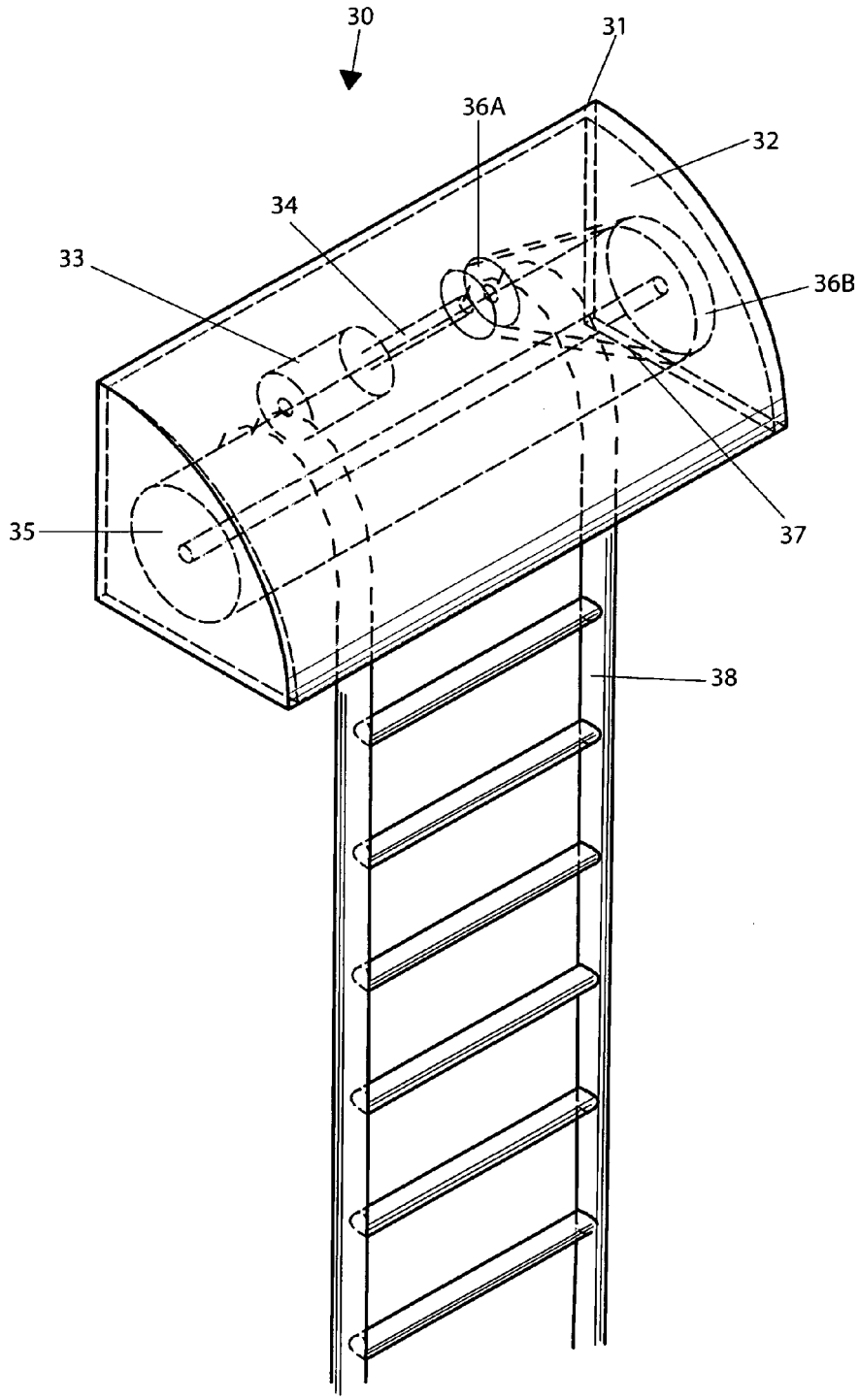
FIG. 7 is an enlarged perspective view of the ladder assembly shown in FIG. 6.
Figure 8:
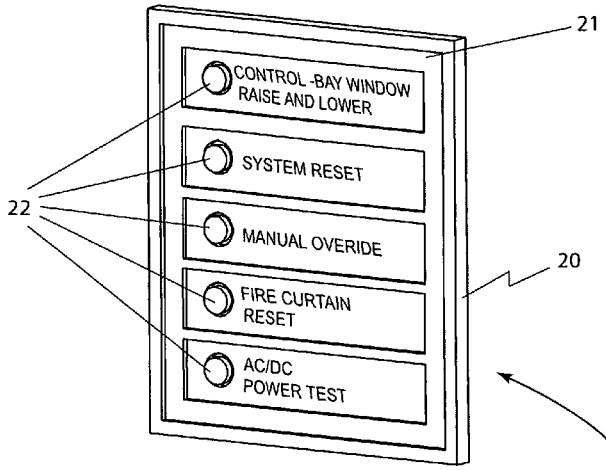
FIG. 8 is an enlarged front-elevational view of the controller user interface shown in FIG. 9.
Figure 9:
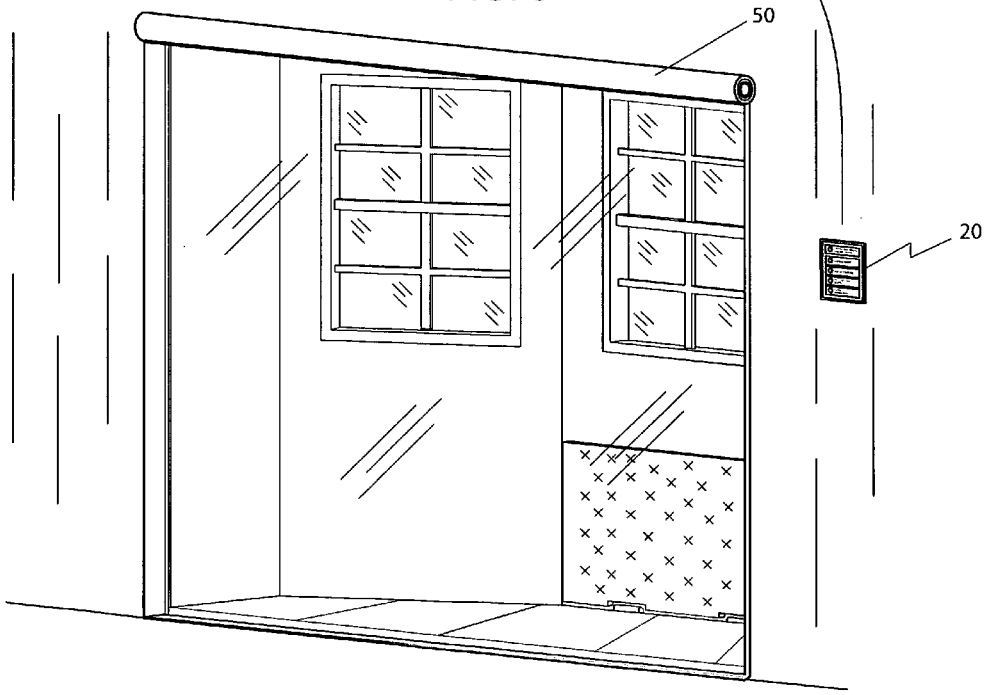
FIG. 9 is a perspective view showing a protective fire curtain assembly, in accordance with the present invention.
Figure 10:
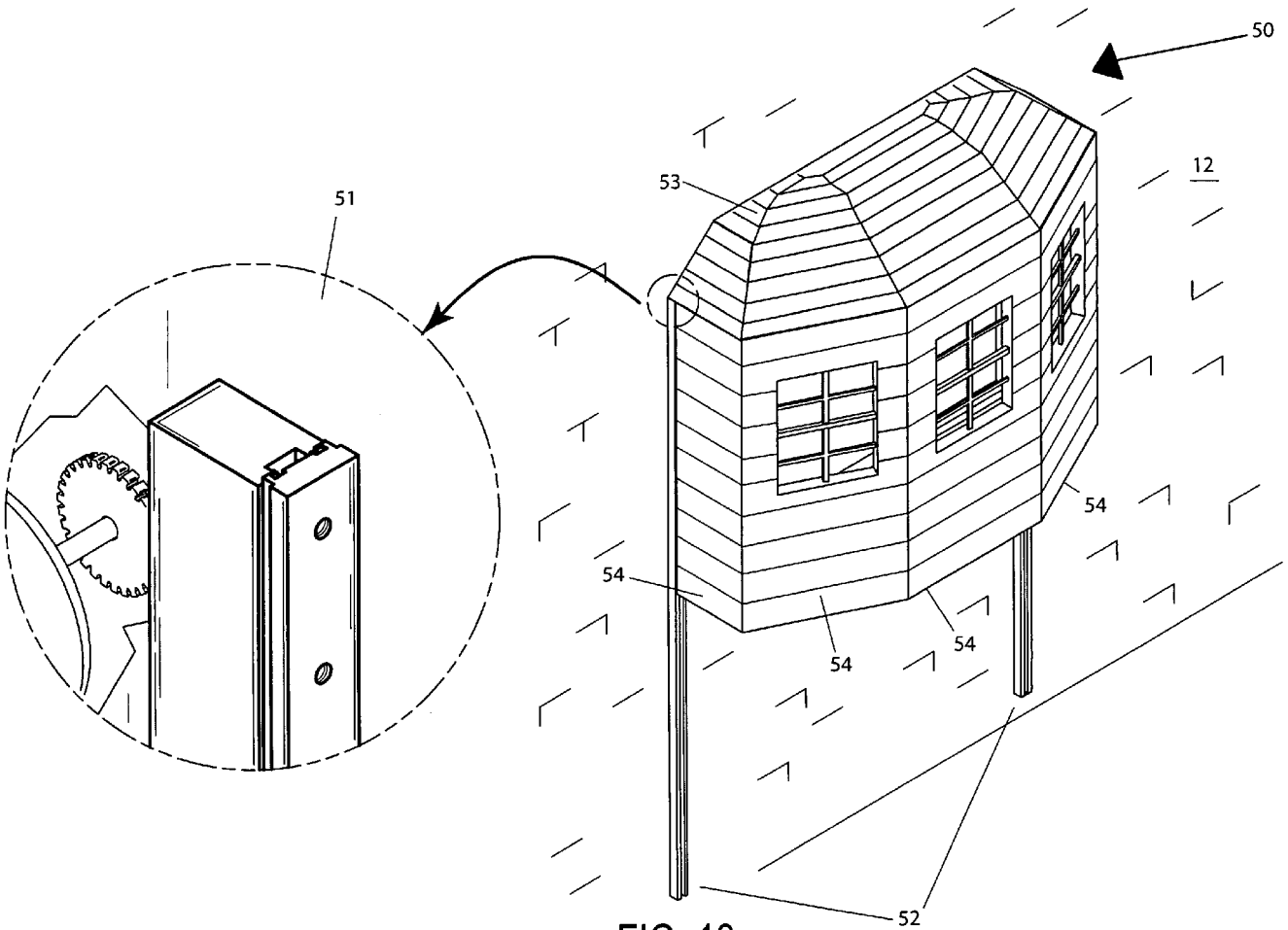
FIG. 10 is an exterior perspective view of the protective fire curtain assembly shown in FIG. 9, showing the plastic awning at a raised state.
Figure 11:
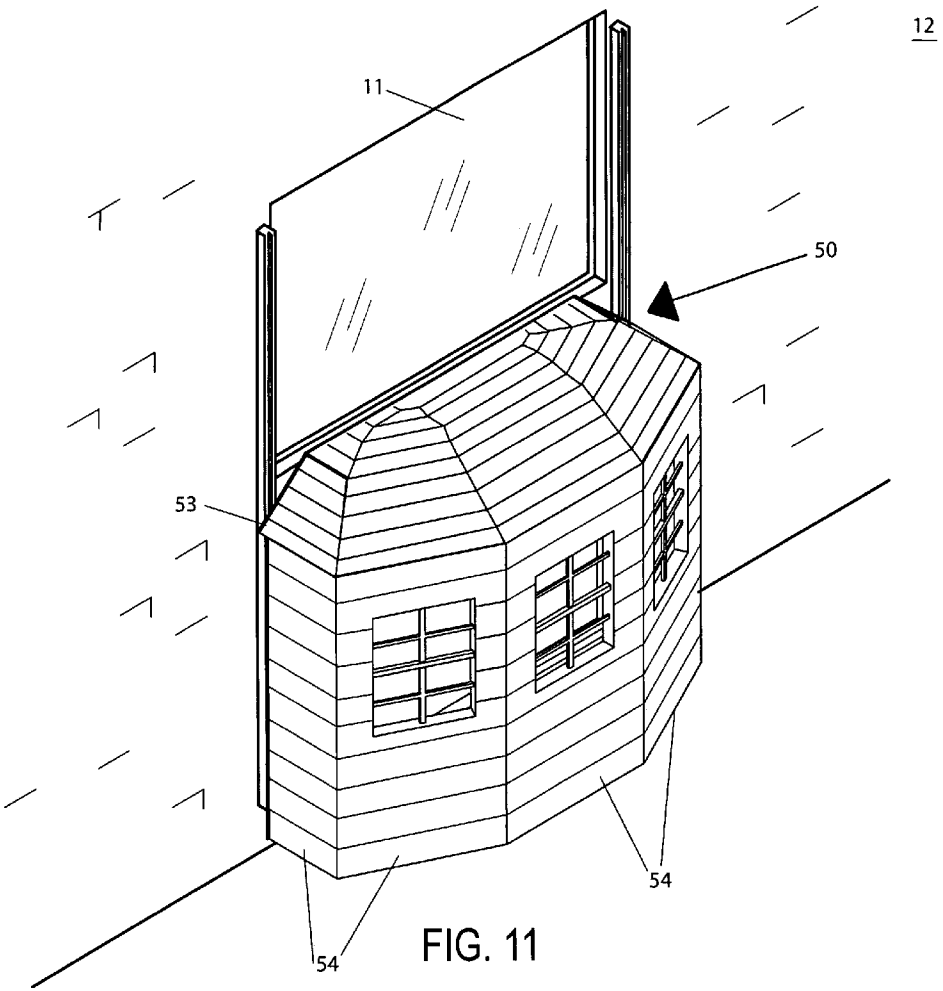
FIG. 11 is a perspective view of the protective fire curtain assembly shown in FIG. 10, showing the awning and fire curtain at lowered states for protecting the person located therein.
Figure 12:
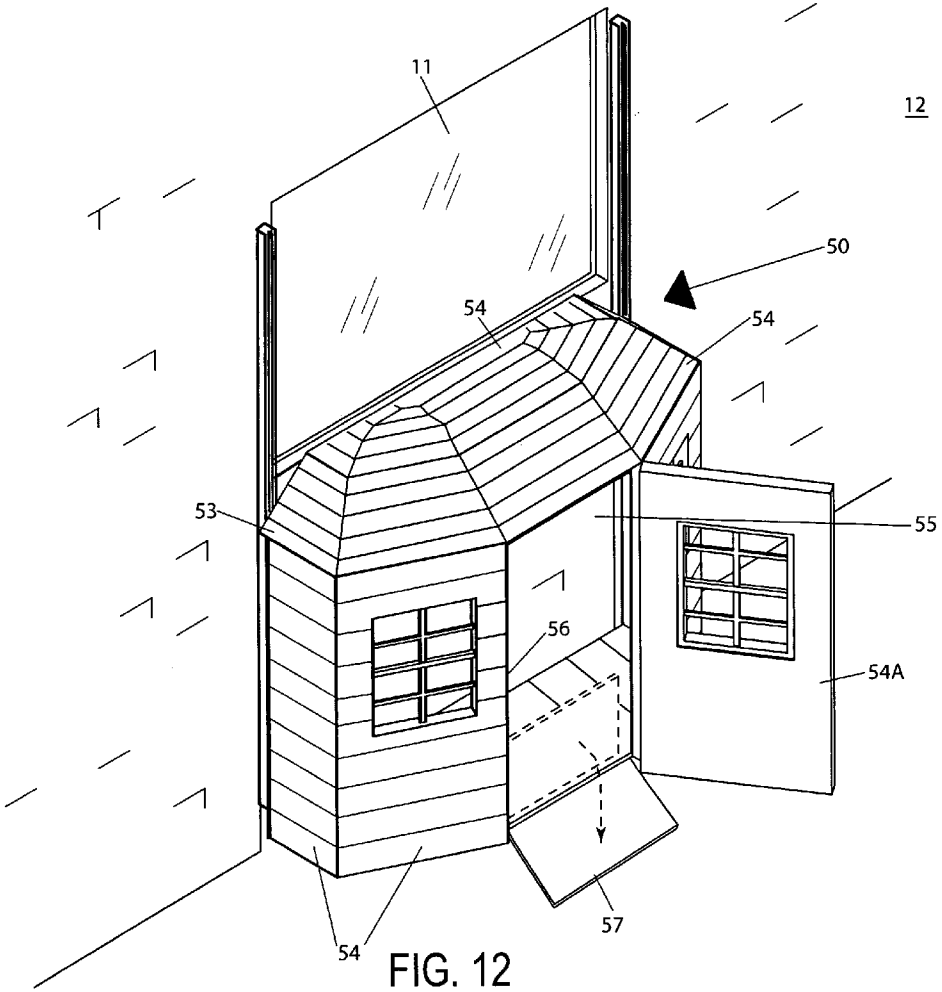
FIG. 12 is a perspective view of the protective fire curtain assembly shown in FIG. 11, showing a door within the awning biased to an open state for allowing the occupant to safely exit to an exterior of the dwelling.
Figure 16:
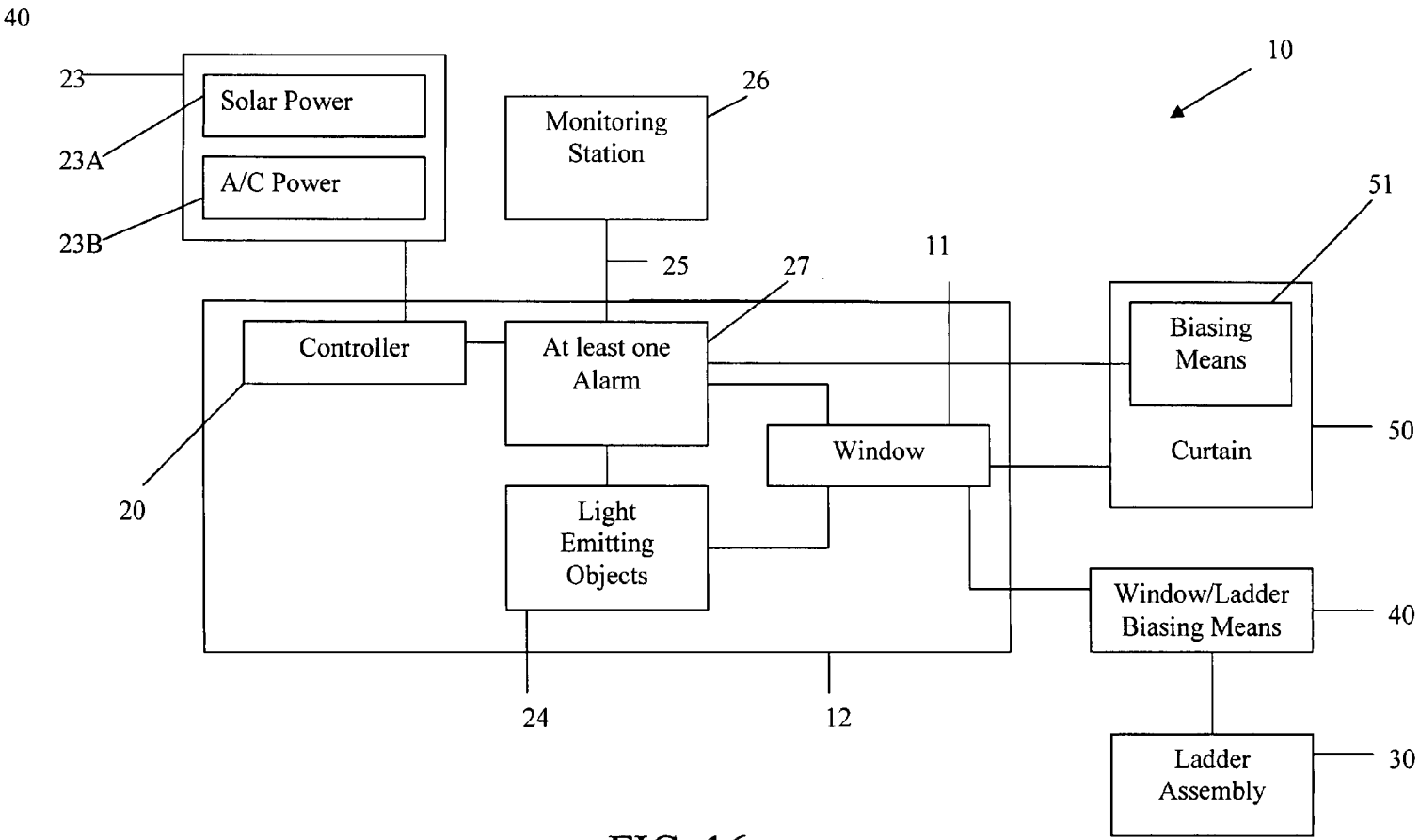
FIG. 16 is a schematic block diagram of the system shown in FIG. 1.

Referring to FIGS. 1, 6 and 16, a plurality of illuminable light emitting objects 24 are seated about a perimeter of the window 11 and face towards an interior of the dwelling 12.

Such light emitting objects 24 are horizontally and vertically oriented, which is important for advantageously and effectively defining a location and shape of the window 11. Of course, the light emitting objects 24 may be programmed to intermittently flash or to illuminate in a rotating fashion for increasing the visibility of the window 11, as is obvious to a person of ordinary skill in the art.

Referring to FIG. 16, a dedicated communications link 25 is provided for transmitting a distress signal to a remotely located monitoring system 26. Such a dedicated communications link 25 is electrically coupled to at least one alarm 27 selected from the group including a smoke alarm, a fire alarm, a carbon monoxide alarm and a security system alarm of the dwelling. Of course, the dedicated communications link 25 may also be connected to a fire sprinkler system, as is obvious to a person of ordinary skill in the art.

Referring to FIGS. 1, 2, 3, 6, 7, 16 and 17, a ladder assembly 30 is housed to an exterior of the dwelling 12 and is positioned adjacent to the window 11. Such a ladder assembly 30 is positioned directly above the window 11 and includes a protective awning 31 that has a curvilinear top surface 32 sloping downwardly and away from the dwelling 12, which is important for effectively directing precipitation and other falling debris away from the ladder assembly 30. A motor 33 has a linear drive shaft 34 directly coupled thereto, without the use of intervening elements. Such a motor 33 and drive shaft 34 are nested beneath the awning 31. A spool 35 is horizontally registered adjacent to the motor 33. First 36A and second 36B pulleys are directly connected, without the use of intervening elements, to the drive shaft 34 and the spool 35 respectively. A unitary belt 37 is coupled about the first 36A and second 36B pulleys. The ladder 38 is journaled about the spool 35 and is selectively released when the motor 33 rotates the drive shaft 34 such that the first 36A and second 36B pulleys rotate in sync and effectively cause the ladder 38 to wind and unwind about the spool 35 during emergency situations.

Figure 5:
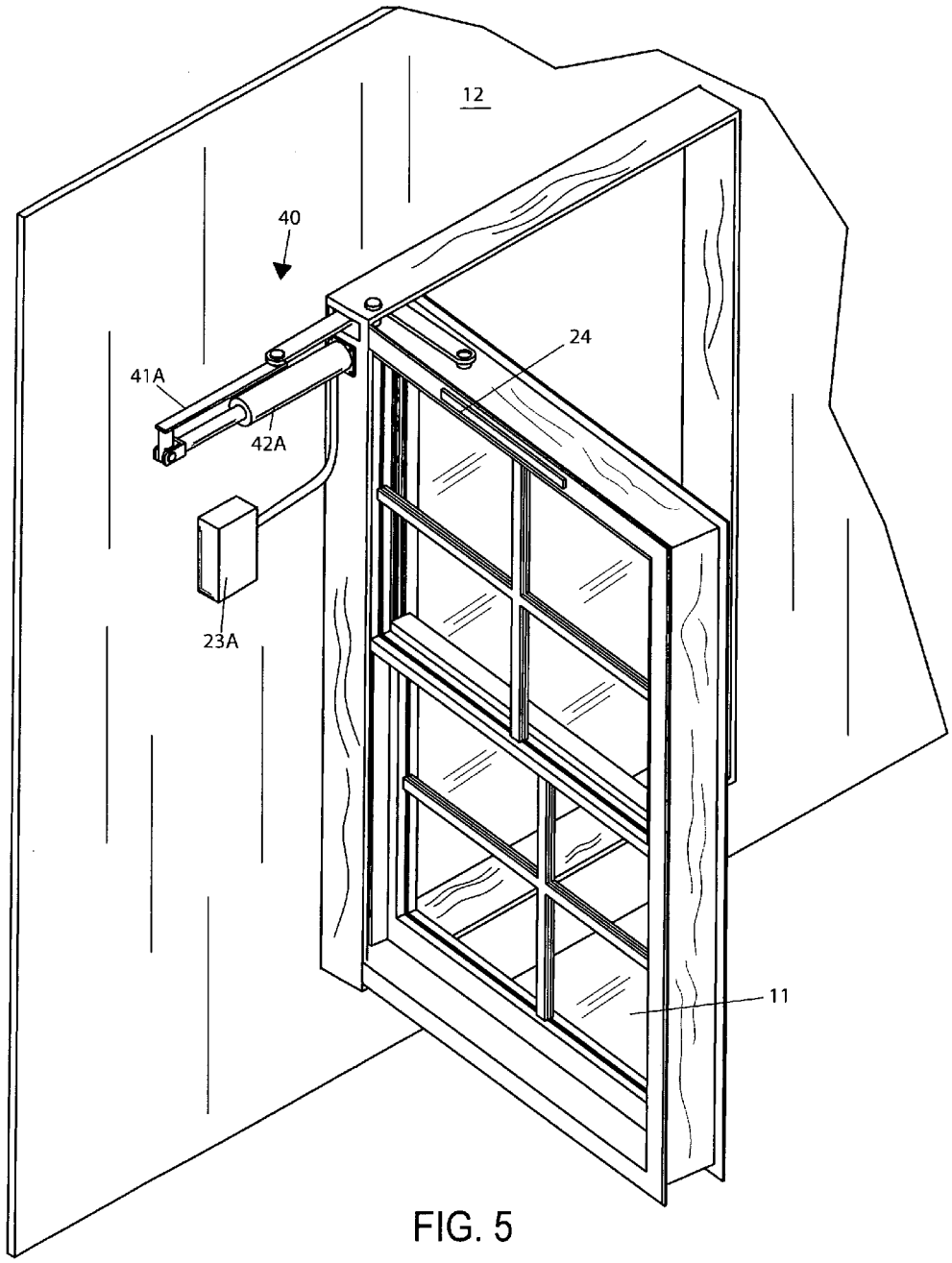
FIG. 5 is a perspective view showing the automatic window biasing mechanism, in accordance with the present invention.
Figure 17:
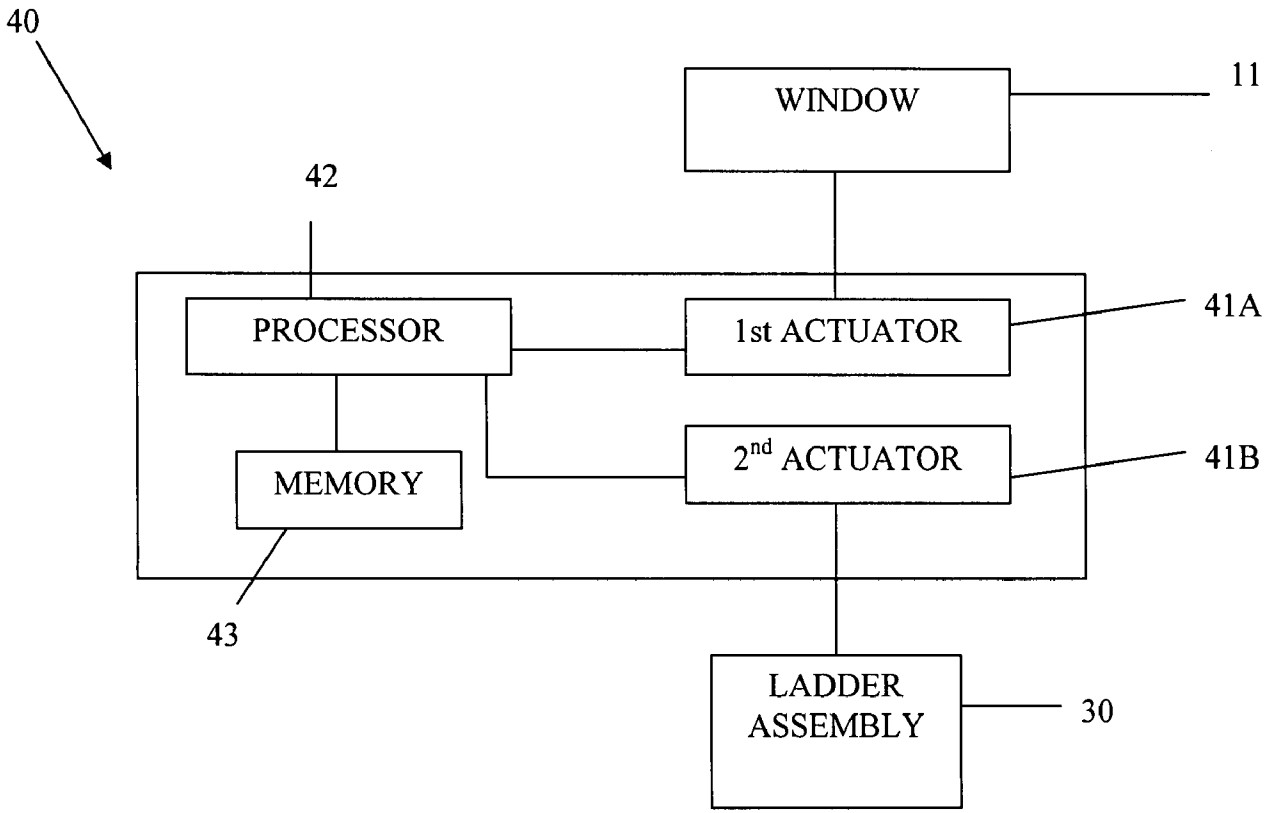
FIG. 17 is a schematic block diagram of the window and ladder assembly biasing mechanism shown in FIG. 16.

Referring to FIGS. 5, 16 and 17, a mechanism 40 is included for automatically biasing the window 11 and the ladder assembly 30 to an open position, which is vital such that the disabled occupant is advantageously and effectively able to exit the dwelling 12 through the window 11 via the ladder assembly 30 respectively. The automatic window biasing mechanism 40 and the illuminable light emitting objects 24 are responsive to a distress signal emitted from the at least one alarm 27. Such an automatic window biasing mechanism 40 includes first 41A and second 41B actuators that are operably coupled to the window 11 and to the ladder assembly 30 respectively, as is best shown in FIG. 17.

Referring to FIG. 17, a processor 42 is electrically coupled to the first 41A and second 41B actuators, and a memory 43 is electrically coupled to the processor 42. Such a memory 43 includes software instructions that effectively and conveniently cause the window 11 to pivot along a vertical axis and swing outwardly away from the dwelling 12. The software instructions execute a programmable logic algorithm that includes the steps of determining whether the distress signal has been transmitted, calculating a period of time since the distress signal was initially transmitted, and comparing the time period with a threshold time period. Further steps include determining if the time period is less than the threshold time period, conveniently ignoring the distress signal and resetting the time period to a false value, and if the time period is greater than the threshold time period, effectively generating and simultaneously transmitting a plurality of control signals to the first 41A and second 41B actuators such that the window 11 and the ladder assembly 30 are advantageously simultaneously biased to open and expanded positions respectively.

Referring to FIGS. 9, 10, 11, 12, 13, 14, 15 and 16, a protective fire curtain assembly 50 is directly coupled, without the use of intervening elements, to an exterior of the window 11 of the dwelling 12. A mechanism 51 is included for automatically biasing the fire curtain assembly 50 between raised and lowered positions when the distress signal is detected from the at least one alarm 27. Such a biasing mechanism 51 is electrically coupled directly, without the use of intervening elements, to the at least one alarm 27 such that said fire curtain assembly 50 automatically biases to the raised position after the occupants have exited the dwelling 12. The protective fire curtain assembly 50 further includes a pair of linear guide rails 52 that are directly connected, without the use of intervening elements, to an exterior of the dwelling 12 and vertically oriented on opposed sides of the window 11. Each of the guide rails 52 has coextensive lengths traveling along an entire longitudinal height of the window 11.

A flexible awning 53 has a plurality of planar sides 54 that protrude outwardly from a periphery of the window 11. Such sides 54 are statically affixed to each other and define a hollow cavity 55 between the window 11 and an inner wall 56 of the awning 53 that is crucial for effectively and advantageously sheltering the disabled occupant from an interior of the dwelling 12 and exterior ambient surroundings. The awning 53 also includes a ramp 57 that is adaptable between raised and lowered positions. One side 54A of the awning 53 can be biased to an open position, wherein the ramp 57 is lowered for advantageously and effectively allowing the person sheltered within the awning 53 to exit therefrom.

Figure 13:
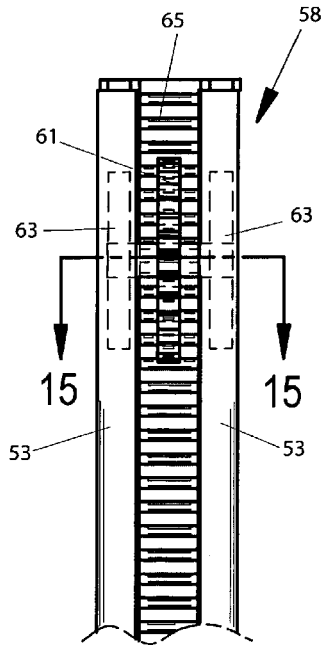
FIG. 13 is a front-elevational view of the guide rails shown in FIG. 12.
Figure 14:
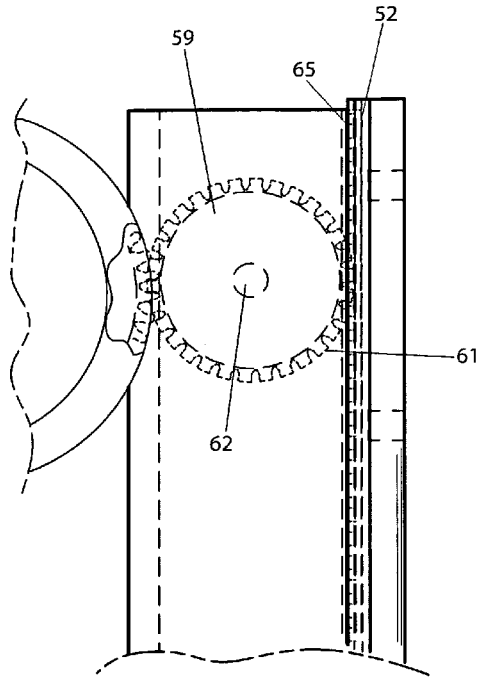
FIG. 14 is a side-elevational view of the guide rails shown in FIG. 13.
Figure 15:
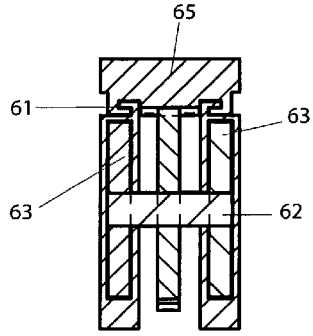
FIG. 15 is a cross-sectional view of the guide rails shown in FIG. 13, taken along line 15-15.

Referring to FIGS. 13, 14 and 15, a motor assembly 58 is electrically coupled to the controller 20. At least one rotary gear assembly 59 is housed within an exterior wall of the dwelling 12 and is operably engaged directly, without the use of intervening elements, with at least one of the guide rails 52. Such a rotary gear assembly 59 includes a toothed drive gear 61 that is partially seated within the one guide rail 52. A linear anchor arm 62 traverses through a center of the rotary gear 59. A pair of coextensively shaped rollers 63 are equidistantly spaced along opposed sides 64 of the drive gear 61. Such rollers 63 are operably connected to the awning 53. A slotted linear track 65 is contiguously housed within the one guide rail 52 and extends along an interior chamber thereof. The drive gear 61 is continuously locked with the track 65, which is vital such that the rollers 63 effectively bias the awning 53 along the guide rails 52 when the distress signal is emitted by the at least one alarm 27.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-functional emergency egress system for assisting occupants of a dwelling to escape from hazardous conditions, said emergency egress system comprising:

a controller located within said dwelling and disposed adjacent to a window of said dwelling;

a plurality of illuminable light emitting objects seated about a perimeter of said window and facing interior of said dwelling, said light emitting objects being horizontally and vertically oriented for defining a location and shape of said window;

a dedicated communications link for transmitting a distress signal to a remotely located monitoring system, said dedicated communications link being electrically coupled to at least one alarm selected from the group including a smoke alarm, a fire alarm, a carbon monoxide alarm and a security system alarm of said dwelling;

a ladder assembly housed exterior of said dwelling and adjacent to said window; and means for automatically biasing said window and said ladder assembly to an open position such that the disabled occupant is able to exit said dwelling through said window and via said ladder assembly respectively;

wherein said automatic window biasing means and said illuminable light emitting objects are responsive to a distress signal emitted from said at least one alarm;

wherein said ladder assembly is positioned directly above said window and comprises:

a protective awning having a curvilinear top surface sloping downward and away from said dwelling;

a motor having a linear drive shaft directly coupled thereto, said motor and said drive shaft being nested beneath said awning;

a spool horizontally registered adjacent to said motor;

first and second pulleys directly connected to said drive shaft and said spool respectively;

a unitary belt coupled about said first and second pulleys;

wherein said ladder is journaled about said spool and is selectively released when said motor rotates said drive shaft such that said first and second pulleys rotate in sync and cause said ladder to wind and unwind about said spool during emergency situations.

2. The system of claim 1, wherein said automatic window biasing means comprises:

first and second actuators operably coupled to said window and to said ladder assembly respectively;

a processor; and a memory electrically coupled to said processor, said memory including software instructions that cause said window to pivot along a vertical axis and swing outwardly away from said dwelling, said software instructions executing a programmable logic algorithm including the steps of a. determining whether said distress signal has been transmitted, b. calculating a period of time since said distress signal was initially transmitted, c. comparing said time period with a threshold time period, d. if said time period is less than said threshold time period, ignoring said distress signal and resetting said time period to a false value, and e. if said time period is greater than said threshold time period, generating and simultaneously transmitting a plurality of control signals to said first and second actuators such that said window and said ladder assembly are simultaneously biased to open and expanded positions respectively.

3. The system of claim 1, a protective fire curtain assembly directly coupled to an exterior of said window of said dwelling; and means for automatically biasing said fire curtain assembly between raised and lowered positions when said distress signal is detected from said at least one alarm, said biasing means being electrically coupled directly to said at least one alarm such that said fire curtain assembly automatically biases to the raised position after the occupants have exited the dwelling.

4. The system of claim 3, wherein said protective fire curtain assembly comprises:

a pair of linear guide rails directly connected to an exterior of said dwelling and vertically oriented on opposed sides of said window, each of said guide rails having coextensive lengths traveling along an entire longitudinal height of said window;

a flexible awning having a plurality of planar sides protruding outwardly from a periphery of said window, said sides being statically affixed to each other and defining a hollow cavity between said window and an inner wall of said awning for sheltering the disabled occupant from an interior of said dwelling and exterior ambient surroundings;

a motor assembly electrically coupled to said controller;

at least one rotary gear assembly housed within an exterior wall of said dwelling and operably engaged directly with at least one of said guide rails, said rotary gear assembly including a toothed drive gear partially seated within said one guide rail, a linear anchor arm traversing through a center of said rotary gear, and a pair of coextensively shaped rollers equidistantly spaced along opposed sides of said drive gear, said rollers being operably connected to said awning;

a slotted linear track contiguously housed within said one guide rail and extending along an interior chamber thereof;

wherein said drive gear is continuously locked with said track such that said rollers bias said awning along said guide tracks when said distress signal is emitted by said at least one alarm.

5. A multi-functional emergency egress system for assisting occupants of a dwelling to escape from hazardous conditions, said emergency egress system comprising:

a controller located within said dwelling and disposed adjacent to a window of said dwelling, wherein said controller includes a user interface;

a plurality of illuminable light emitting objects seated about a perimeter of said window and facing interior of said dwelling, said light emitting objects being horizontally and vertically oriented for defining a location and shape of said window;

a dedicated communications link for transmitting a distress signal to a remotely located monitoring system, said dedicated communications link being electrically coupled to at least one alarm selected from the group including a smoke alarm, a fire alarm, a carbon monoxide alarm and a security system alarm of said dwelling;

a ladder assembly housed exterior of said dwelling and adjacent to said window; and means for automatically biasing said window and said ladder assembly to an open position such that the disabled occupant is able to exit said dwelling through said window and via said ladder assembly respectively;

wherein said automatic window biasing means and said illuminable light emitting objects are responsive to a distress signal emitted from said at least one alarm;

wherein said ladder assembly is positioned directly above said window and comprises;

a protective awning having a curvilinear top surface sloping downwardly and away from said dwelling;

a motor having a linear drive shaft directly coupled thereto, said motor and said drive shaft being nested beneath said awning;

a spoof horizontally registered adjacent to said motor;

first and second pulleys directly connected to said drive shaft and said spool respectively;

a unitary belt coupled about said first and second pulleys;

wherein said ladder is journaled about said spool and is selectively released when said motor rotates said drive shaft such that said first and second pulleys rotate in sync and cause said ladder to wind and unwind about said spool during emergency situations.

6. The system of claim 5, wherein said automatic window biasing means comprises:

first and second actuators operably coupled to said window and to said ladder assembly respectively;

a processor; and a memory electrically coupled to said processor, said memory including software instructions that cause said window to pivot along a vertical axis and swing outwardly away from said dwelling, said software instructions executing a programmable logic algorithm including the steps of a. determining whether said distress signal has been transmitted, b. calculating a period of time since said distress signal was initially transmitted, c. comparing said time period with a threshold time period, d. if said time period is less than said threshold time period, ignoring said distress signal and resetting said time period to a false value, and e. if said time period is greater than said threshold time period, generating and simultaneously transmitting a plurality of control signals to said first and second actuators such that said window and said ladder assembly are simultaneously biased to open and expanded positions respectively.

7. The system of claim 5, a protective fire curtain assembly directly coupled to an exterior of said window of said dwelling; and means for automatically biasing said fire curtain assembly between raised and lowered positions when said distress signal is detected from said at least one alarm, said biasing means being electrically coupled directly to said at least one alarm such that said fire curtain assembly automatically biases to the raised position after the occupants have exited the dwelling.

8. The system of claim 7, wherein said protective fire curtain assembly comprises:

a pair of linear guide rails directly connected to an exterior of said dwelling and vertically oriented on opposed sides of said window, each of said guide rails having coextensive lengths traveling along an entire longitudinal height of said window;

a flexible awning having a plurality of planar sides protruding outwardly from a periphery of said window, said sides being statically affixed to each other and defining a hollow cavity between said window and an inner wall of said awning for sheltering the disabled occupant from an interior of said dwelling and exterior ambient surroundings;

a motor assembly electrically coupled to said controller;

at least one rotary gear assembly housed within an exterior wall of said dwelling and operably engaged directly with at least one of said guide rails, said rotary gear assembly including a toothed drive gear partially seated within said one guide rail, a linear anchor arm traversing through a center of said rotary gear, and a pair of coextensively shaped rollers equidistantly spaced along opposed sides of said drive gear, said rollers being operably connected to said awning;

a slotted linear track contiguously housed within said one guide rail and extending along an interior chamber thereof;

wherein said drive gear is continuously locked with said track such that said rollers bias said awning along said guide tracks when said distress signal is emitted by said at least one alarm.

9. A multi-functional emergency egress system for assisting a disabled occupant of a dwelling to escape from hazardous conditions, said emergency egress system comprising:

a controller located within said dwelling and disposed adjacent to a window of said dwelling, wherein said controller includes a user interface, wherein said controller is electrically coupled to an external power supply source including at least one of a solar power supply source and an alternating current power supply source respectively;

a plurality of illuminable light emitting objects seated about a perimeter of said window and facing interior of said dwelling, said light emitting objects being horizontally and vertically oriented for defining a location and shape of said window;

a dedicated communications link for transmitting a distress signal to a remotely located monitoring system, said dedicated communications link being electrically coupled to at least one alarm selected from the group including a smoke alarm, a fire alarm, a carbon monoxide alarm and a security system alarm of said dwelling;

a ladder assembly housed exterior of said dwelling and adjacent to said window; and means for automatically biasing said window and said ladder assembly to an open position such that the disabled occupant is able to exit said dwelling through said window and via said ladder assembly respectively;

wherein said automatic window biasing means and said illuminable light emitting objects are responsive to a distress signal emitted from said at least one alarm;

wherein said ladder assembly is positioned directly above said window and comprises:

a protective awning having a curvilinear top surface sloping downwardly and away from said dwelling;

a motor having a linear drive shaft directly coupled thereto, said motor and said drive shaft being nested beneath said awning;

a spool horizontally registered adjacent to said motor;

first and second pulleys directly connected to said drive shaft and said spool respectively;

a unitary belt coupled about said first and second pulleys;

wherein said ladder is journaled about said spool and is selectively released when said motor rotates said drive shaft such that said first and second pulleys rotate in sync and cause said ladder to wind and unwind about said spool during emergency situations.

10. The system of claim 9, wherein said automatic window biasing means comprises:

first and second actuators operably coupled to said window and to said ladder assembly respectively;

a processor; and a memory electrically coupled to said processor, said memory including software instructions that cause said window to pivot along a vertical axis and swing outwardly away from said dwelling, said software instructions executing a programmable logic algorithm including the steps of a. determining whether said distress signal has been transmitted, b. calculating a period of time since said distress signal was initially transmitted, c. comparing said time period with a threshold time period, d. if said time period is less than said threshold time period, ignoring said distress signal and resetting said time period to a false value, and e. if said time period is greater than said threshold time period, generating and simultaneously transmitting a plurality of control signals to said first and second actuators such that said window and said ladder assembly are simultaneously biased to open and expanded positions respectively.

11. The system of claim 9, a protective fire curtain assembly directly coupled to an exterior of said window of said dwelling; and means for automatically biasing said fire curtain assembly between raised and lowered positions when said distress signal is detected from said at least one alarm, said biasing means being electrically coupled directly to said at least one alarm such that said fire curtain assembly automatically biases to the raised position after the occupants have exited the dwelling.

12. The system of claim 11, wherein said protective fire curtain assembly comprises;

a pair of linear guide rails directly connected to an exterior of said dwelling and vertically oriented on opposed sides of said window, each of said guide rails having coextensive lengths traveling along an entire longitudinal height of said window;

a flexible awning having a plurality of planar sides protruding outwardly from a periphery of said window, said sides being statically affixed to each other and defining a hollow cavity between said window and an inner wall of said awning for sheltering the disabled occupant from an interior of said dwelling and exterior ambient surroundings;

a motor assembly electrically coupled to said controller;

at least one rotary gear assembly housed within an exterior wall of said dwelling and operably engaged directly with at least one of said guide rails, said rotary gear assembly including a toothed drive gear partially seated within said one guide rail, a linear anchor arm traversing through a center of said rotary gear, and a pair of coextensively shaped rollers equidistantly spaced along opposed sides of said drive gear, said rollers being operably connected to said awning;

a slotted linear track contiguously housed within said one guide rail and extending along an interior chamber thereof;

wherein said drive gear is continuously locked with said track such that said rollers bias said awning along said guide tracks when said distress signal is emitted by said at least one alarm.

* * * * *